US007108158B2

(12) United States Patent
Airaksinen

(10) Patent No.: US 7,108,158 B2
(45) Date of Patent: Sep. 19, 2006

(54) LIQUID DISPENSING DEVICE

(75) Inventor: Pentti Airaksinen, Oulu (FI)

(73) Assignee: CPS Color Group Oy, Vantaa (FI)

( * ) Notice: Subject to any disclaimer, the term of this patent is extended or adjusted under 35 U.S.C. 154(b) by 256 days.

(21) Appl. No.: 10/481,626

(22) PCT Filed: Jun. 18, 2002

(86) PCT No.: PCT/FI02/00535

§ 371 (c)(1),
(2), (4) Date: Dec. 19, 2003

(87) PCT Pub. No.: WO03/001059

PCT Pub. Date: Jan. 3, 2003

(65) Prior Publication Data

US 2004/0173641 A1 Sep. 9, 2004

(30) Foreign Application Priority Data

Jun. 21, 2001 (FI) ..... 20011337

(51) Int. Cl.
*B67B 5/00* (2006.01)

(52) U.S. Cl. ..... 222/153.13; 417/223

(58) Field of Classification Search ..... 222/153.03, 222/153.13, 390, 386; 417/223, 415, 225
See application file for complete search history.

(56) References Cited

U.S. PATENT DOCUMENTS

| | | | | |
|---|---|---|---|---|
| 4,465,474 | A | | 8/1984 | Mardorf et al. |
| 4,734,719 | A | * | 3/1988 | Suzuki ..... 347/32 |
| 4,769,009 | A | * | 9/1988 | Dykstra ..... 604/155 |
| 5,567,122 | A | | 10/1996 | Schulte |

* cited by examiner

*Primary Examiner*—Gene Mancene
*Assistant Examiner*—Melvin A. Cartagena
(74) *Attorney, Agent, or Firm*—Young & Thompson

(57) ABSTRACT

A liquid dispensing device includes at least one piston pump (7), which sucks liquid to be dispensed from a container in a filling cycle and applies the liquid to a target in an emptying cycle and which is driven by an actuator comprising an actuating element (1) that is arranged to move a piston rod (2) between two extreme positions, and a gripper (3) attached to the actuating means (1), which gripper is able to engage with the piston rod (2) so as to move it along with the actuating element. The gripper (3) is made able to engage with the piston rod (2) only in its first extreme position and arranged to disengage automatically from the piston rod in its second extreme position.

7 Claims, 2 Drawing Sheets

2/2

LIQUID DISPENSING DEVICE

BACKGROUND OF THE INVENTION

The invention relates to a liquid dispensing device comprising at least one piston pump, which sucks liquid to be dispensed from a container in a filling cycle and applies said liquid to a target in an emptying cycle and which is driven by an actuator comprising an actuating means that is arranged to move a piston rod between two extreme positions, and a gripper attached to the actuating means, which gripper is able to engage with the piston rod so as to move it along with the actuating means. The extreme positions refer to the two positions between which the piston is shifted in the cylinder of the piston pump. These positions need not correspond to those of empty and full piston pumps.

A dispensing device as described above is known from U.S. Pat. No. 5,567,122. The gripper, which in this case is a pin moved by a solenoid, is arranged to move along with the actuator. To retain the engagement of the gripper requires continuous power supply to the solenoid. Because the gripper moves with the actuator, the power supply must be arranged by means of flexible cables or the like arrangements. If the apparatus includes a plurality of piston rods, like the paint toning machine which is intended to be a particular application of the present invention, the gripping arrangement of the U.S. Pat. No. 5,567,122 is difficult, complicated and space-consuming.

As stated above, dispensing devices of the invention are used, in particular, for dispensing colour paste. In some known dispensing devices the actuating means of the actuator driving the piston pump is continuously in cooperation with the piston rod, and as the actuating means moves so does the piston rod. The cooperation between the piston pump and the actuator is advantageous in a dispensing device comprising one piston pump, but when a plurality of piston pumps are driven by one and the same actuator, the situation is always such that only some of the piston pumps are desired to supply colour paste. Because the actuator is coupled to all piston rods, it is not possible to stop the movement of the idle piston pumps but liquid dispensing from said pumps must be prevented by valve operations.

A problem with the above-described arrangement is that the idle piston pumps move unnecessarily with the actuator, which wastes energy and results in unnecessarily fast wearing of the parts. Complicated valve arrangements may also cause problems, because the automation system thereof should take care of stopping and restarting the liquid dispensing.

SUMMARY OF THE INVENTION

The object of the invention is thus to provide a dispensing apparatus, in which the above problems can be solved. This is achieved with a dispensing device, which is characterized in that a gripper is made able to engage with a piston rod in its first extreme position and to disengage automatically from the piston rod in its second extreme position.

The basic idea of the invention is thus to disengage the piston rod from its actuating means in the second extreme position, irrespective of whether the position is that of a full or empty piston pump. To some extent it is a matter of choice, whether the piston pump is left full or empty when it is disengaged from its actuating means. If the piston pump is left full, it will be immediately ready to dispense, but on the other hand, the substance to be dispensed may be such that it will not tolerate extended storage in the piston pump cylinder, whereby it is more advantageous to perform the disengagement in the position where the piston pump is empty.

It is often advantageous that the gripper is made able to engage with the piston rod at the beginning of the filling cycle of said piston pump and to disengage automatically from the piston rod at the beginning of the emptying cycle of said piston pump.

Advantageously, the resting position of the gripper is the position where it does not provide engagement between the actuating means and the piston rod. Thus, the actuating means controlling the gripper needs to be activated only at a gripping moment.

Because the gripper is arranged to engage with the piston rod only in the second extreme position thereof, it is advantageous to proceed such that the gripper is made able to engage with the piston rod by means of an actuating means having a fixed position with respect to the dispensing device, such as a solenoid, which is arranged to turn the gripper from the resting position to a position, in which it takes along the piston rod.

In the dispensing device of the invention, the actuating means, such as solenoids, can have fixed positions and they are only used in a pulse-like manner so as to make the gripper engage with the piston rod for the duration of the piston pump filling cycle. When the actuator proceeds to an emptying cycle, the gripper disengages automatically and the piston pump concerned does not participate in the next filling cycle, unless the piston rod of said piston pump is separately made to engage with its actuator.

The arrangement of the invention has an advantage that the use of the multi-pump dispensing device becomes lighter, because only the piston pumps in operation move with the actuating means. It is easy to disengage and engage piston pumps with the actuator without causing interruptions in the movement of the actuator and thereby in the other pistons.

BRIEF DESCRIPTION OF THE DRAWINGS

In the following the invention will be described in greater detail, in connection with an exemplary embodiment with reference to the attached drawing, wherein.

DETAILED DESCRIPTION OF THE INVENTION

Figure 1:
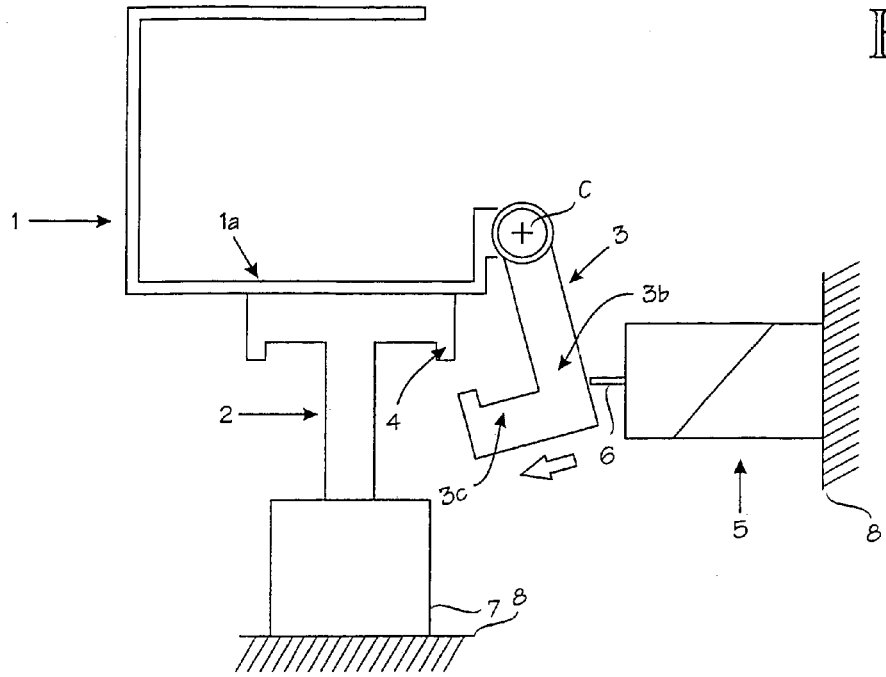
FIG. 1 shows an actuating means and a piston rod of a dispensing device according to the invention at the end of the emptying cycle of the pump.

FIG. 1 shows an actuating means 1 of an actuator in a liquid dispensing device provided with a gripper 3 moving therewith for engaging with a piston rod 2 of a piston pump 7. The task of the actuating means 1 is to move the piston rod 2 between the extreme positions thereof such that in the emptying cycle of the piston pump 7 the actuating means 1 pushes the piston rod 2 downwardly from a surface a (FIG. 2) with a flange 1*a*, and in the filling cycle, the gripper 3 attached to the actuating means 1 moves the piston rod while being engaged with a projecting part 4 thereof.

In a situation illustrated in FIG. 1, the piston rod 2 is in an end position of the emptying cycle, to which the flange 1*a* of the actuating means 1 has pushed it. In this position the gripper 3 of the actuating means 1 is in its resting position, i.e. it is not engaged with the piston rod 2. This gripper, which in the embodiment of the figure is in the shape of letter J, is turned to a position with respect to its pivot point C that it does get engaged behind the projecting part or lip 4 in the upper end of the piston rod 2, when the actuating means 1 is moved with respect to the piston rod. It is possible to provide this resting position of the gripper 3 with a variety of arrangements not shown in the figures. Firstly, the gripper 3 can be forced into the resting position shown in FIG. 1 by means of a coil spring arranged in the axis C of the gripper. Secondly, it would be possible to use a weight disposed on an extension of the gripper shaft 3*b*, behind the pivot point C, which weight would force the gripper 3 in the inclined position shown in FIG. 1 by means of gravity. The figures do not show a counterbalance of this type either. On the other hand, by the mutual positioning of the fulcrum and the mass centre it is possible to make the gripper adopt a desired position in the resting position.

Figure 2:
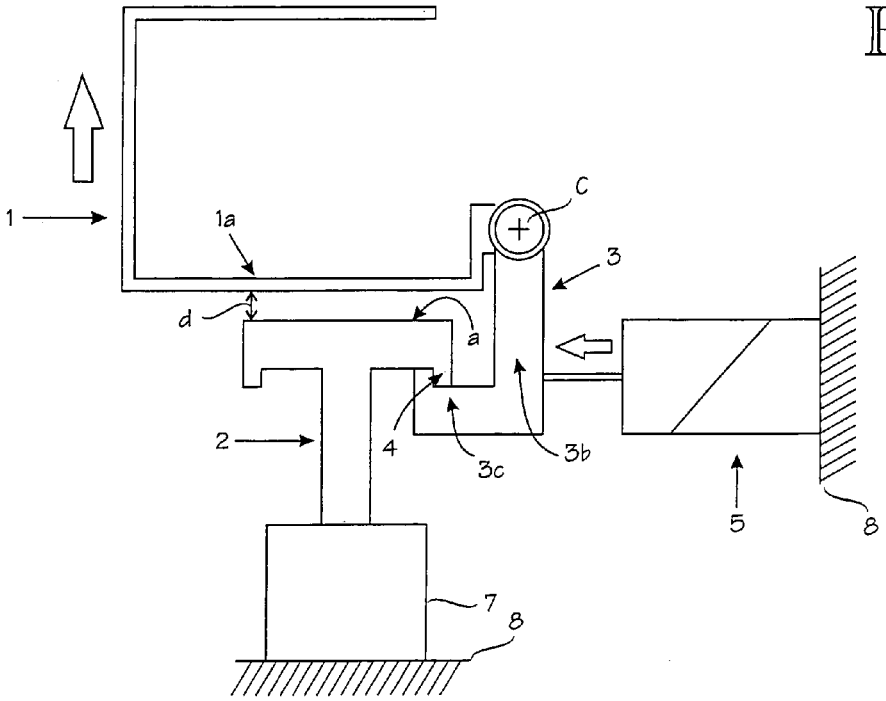
FIG. 2 shows the dispensing device of FIG. 1 with a gripper having engaged with the piston rod at the beginning of the filling cycle of the pump.

With the intention of making the piston rod 2 move along with the actuating means 1, a driving means, which is supported to the dispensing device frame 8 and shown as a solenoid 5 in the figures, is given an impulse which makes the pin 6 of the solenoid to turn the gripper from the inclined position to a gripping position, when a hook formed by the gripper tip 3*c* moves behind the projecting part 4 of the piston rod 2. FIG. 2 shows this situation in which the actuating means 1 has already slightly moved in the direction where the pump is filled. It appears from FIG. 2 that there is a clearance d between the flange 1*a* of the actuating means and the upper surface a of the piston rod, and the flange 1*a* and the upper surface a of the piston rod are apart from one another for a degree of this clearance during the pump filling cycle. The clearance d is necessary in order that, on one hand, the gripper 3 can be fitted behind the projecting part 4 of the piston rod head, and on the other hand, can be released therefrom, as will be described below. It should be noted that the degree of the necessary clearance depends on for how long a distance the gripper hook and the projecting part of the piston rod are superimposed in the pump filling cycle. It can be assumed that the clearance d is very small or close to zero if the gripper has no actual hook and the piston rod head has no actual projecting part, but the engagement during the pump filling cycle is based on the friction between the mating surfaces thereof.

Figure 3:
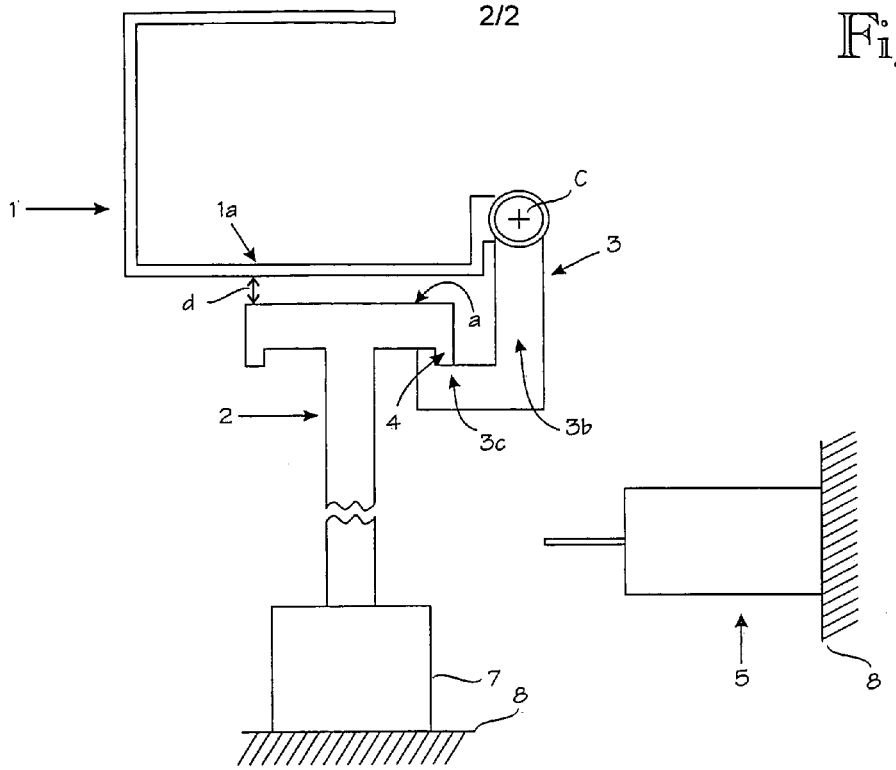
FIG. 3 shows the piston rod of the dispensing device of FIG. 1 at the end of the filling cycle of the pump.
Figure 4:
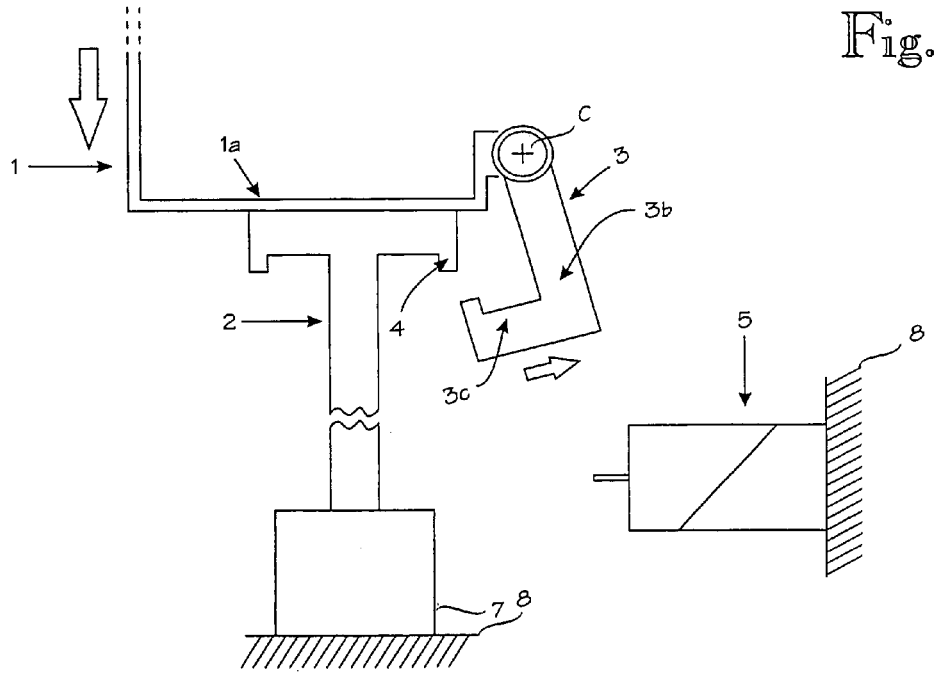
FIG. 4 shows the piston rod of the dispensing device of FIG. 1 at the end of the emptying cycle of the pump.

FIG. 3 shows a situation, in which the actuating means 1 has ascended to a second, predetermined extreme position at the end of the pump filling cycle and thus its movement has been stopped. At its free end 3*c* the gripper 3 is then still engaged behind the projecting part 4 of the piston rod head, and there is a clearance d between the flange 1*a* of the actuating means and the upper surface a of the piston rod head. Now that the actuating means 1 starts the emptying cycle of the pump, it proceeds to a situation shown in FIG. 4. The actuating means 1 can first move for a degree of the clearance d in the direction where the pump is emptied, before the flange 1*a* comes into contact with the head of the piston rod 2. In this situation the tip 3*c* of the gripper 3 is lower than the projecting part 4 of the piston rod head and is thus able to get released from behind the projecting part as shown in FIG. 4. This is based on the fact that the gripper 3 is no longer obstructed by the projecting part 4 but it is able to return to the resting position, as illustrated in FIGS. 1 and 4 in the inclined position, released from the piston rod 2.

After the actuating means 1 has pushed the piston rod 2 in the direction where the pump is emptied up to the second extreme position, the same situation is again achieved as in FIG. 1. If the piston rod 2 is not to be taken along during the next pump filling cycle provided by the actuating means, the driving means 5 is not given a control impulse, and the piston rod 2 does not engage with the actuating means 1. Hence, at the beginning of each pump filling cycle of the actuating means 1 it is necessary to engage the gripper with the piston rod 2, if said piston rod is desired to move along with the actuating means 1. Thus it is very simple and only takes few operations to select the piston rods that are desired to be in operation at any particular time.

The dispensing device of the invention has been described in the above by means of only one exemplary embodiment, and therefore it is to be understood that its structure may vary in a variety of ways without deviating from the scope defined in the attached claims. Firstly, the description concerns a solution, in which the gripper is disengaged from the piston rod in a position where it is when the pump is full, but as it appears from what is stated above, the procedure could also be performed vice versa. In that case, the piston pump would remain full to wait for a moment, when the gripper will catch it, and the dispensing could start immediately. Secondly, it should be noted that only one piston rod in connection with the actuating means was described in the above. Generally, the dispensing device includes a plurality of piston rods, whereby the simple structure provided by the arrangement according to the invention is even more appreciated. Namely, the arrangement according to the invention only requires fixedly positioned solenoids, whose energy-effective, pulse-like operation enables selection of the piston rods that are to be moved at any particular time, i.e. the piston rods that are desired to operate at any particular time.

The invention claimed is:

1. A liquid dispensing device comprising:

at least one piston pump having a piston rod, an actuator comprising an actuating means arranged to move the piston rod between a first and a second extreme position for sucking liquid to be dispensed from a container in a filling cycle and applying said liquid to a target in an emptying cycle, and a gripper attached to the actuating means and able to be engaged with the piston rod in its first extreme position so as to move the piston rod along with the actuating means and to be automatically disengaged from the piston rod in its second extreme position, wherein the gripper is made able to engage with the piston rod at the beginning of the filling cycle of said piston pump and to disengage automatically from the piston rod at the beginning of the emptying cycle of said piston pump.

2. A dispensing device as claimed in claim 1, wherein the gripper has a resting position in which it does not engage the actuating means with the piston rod.

3. A dispensing device as claimed in claim 1, wherein the gripper is made able to engage with the piston rod by means of a fixed driving means, which is arranged to turn the gripper from the resting position to a position, in which it takes along the piston rod.

4. A dispensing device as claimed in claim 1, wherein there is a clearance between the actuating means and the piston rod, which clearance enables the actuating means to move with respect to the piston rod without moving the piston rod.

5. A dispensing device as claimed in claim 1, wherein the actuating means is arranged to move at least two piston rods, each of which having a specific gripper, which enables individual disengagement of the piston rods and hence of the piston pumps.

6. A liquid dispensing device, comprising:

at least one piston pump having a piston rod;

an actuator comprising an actuating means arranged to move the piston rod between a first and a second extreme position for sucking liquid to be dispensed from a container in a filling cycle and applying said liquid to a target in an emptying cycle; and a gripper attached to the actuating means and able to be engaged with the piston rod in its first extreme position so as to move the piston rod along with the actuating means and to be automatically disengaged from the piston rod in its second extreme position, wherein the part of the gripper that engages with the piston rod is a hook, which is arranged to engage behind a projecting part of the head of the piston rod.

7. A liquid dispensing device, comprising:

at least one piston pump having a piston rod;

an actuator comprising an actuating means arranged to move the piston rod between a first and a second extreme position for sucking liquid to be dispensed from a container in a filling cycle and applying said liquid to a target in an emptying cycle; and a gripper attached to the actuating means and able to be engaged with the piston rod in its first extreme position so as to move the piston rod along with the actuating means and to be automatically disengaged from the piston rod in its second extreme position, wherein there is a clearance between the actuating means and the piston rod, which clearance enables the actuating means to move with respect to the piston rod without moving the piston rod, and wherein the gripper is arranged to disengage from the piston rod so that the actuating means shifts in the direction where the piston pump is emptied with respect to the piston rod, whereby the gripper is able to move into the resting position disengaging from the piston rod.

* * * * *